US008381470B2

(12) United States Patent
Boxall et al.

(10) Patent No.: US 8,381,470 B2
(45) Date of Patent: Feb. 26, 2013

(54) TAPERED LOAD PLATE FOR TRANSFERRING LOADS BETWEEN CAST-IN-PLACE SLABS

(76) Inventors: Russell Boxall, Charlotte, NC (US); Nigel K. Parkes, Atlanta, GA (US)

( * ) Notice: Subject to any disclaimer, the term of this patent is extended or adjusted under 35 U.S.C. 154(b) by 415 days.

(21) Appl. No.: 12/749,148

(22) Filed: Mar. 29, 2010

(65) Prior Publication Data

US 2010/0242401 A1 Sep. 30, 2010

Related U.S. Application Data

(63) Continuation-in-part of application No. 12/135,780, filed on Jun. 9, 2008, now Pat. No. 7,716,890, which is a continuation of application No. 10/489,380, filed as application No. PCT/US02/29200 on Sep. 13, 2002, now Pat. No. 7,481,031.

(60) Provisional application No. 60/318,838, filed on Sep. 13, 2001.

(51) Int. Cl.
*E04B 1/682* (2006.01)

(52) U.S. Cl. ..... 52/396.02; 52/402; 52/426; 52/585.1; 404/57; 404/60

(58) Field of Classification Search ..... 52/393, 52/395, 396, 396.02, 396.04, 396.05, 396.07, 52/396.308, 402, 426, 435, 585.1, 677; 404/47, 404/51, 52, 55, 56, 57, 58, 59, 60–67, 134–136
See application file for complete search history.

(56) References Cited

U.S. PATENT DOCUMENTS

| | | | | | |
|---|---|---|---|---|---|
| 2,201,134 | A * | 5/1940 | Brickman et al. | ..... | 404/57 |
| RE21,996 | E * | 1/1942 | Oates | ..... | 404/61 |
| 2,509,180 | A * | 5/1950 | Yeoman | ..... | 404/57 |
| 2,654,297 | A * | 10/1953 | Nettleton | ..... | 404/52 |
| 3,104,600 | A * | 9/1963 | White | ..... | 52/688 |
| 5,674,028 | A * | 10/1997 | Norin | ..... | 404/74 |
| 6,354,760 | B1 * | 3/2002 | Boxall et al. | ..... | 404/56 |
| 6,471,441 | B1 * | 10/2002 | Muller | ..... | 404/62 |
| 2006/0177267 | A1 * | 8/2006 | Carroll | ..... | 404/47 |

* cited by examiner

*Primary Examiner* — William Gilbert
(74) *Attorney, Agent, or Firm* — Banner & Witcoff, Ltd.

(57) ABSTRACT

A tapered load plate transfers loads across a joint between adjacent concrete floor slabs. The top and bottom surfaces may taper from approximately 4 inches wide to a narrow substantially pointed end over a length of approximately 12 inches. The tapered load plate accommodates differential shrinkage of cast-in-place concrete slabs. The tapered load plate may comprise a main plate and at least one extension. When adjacent slabs move away from each other, the narrow end of the tapered load plate moves out of the void that it created in the slab thus allowing the slabs to move relative to one another in a direction parallel to the joint. Tapered load plates may be assembled into a load-plate basket with the direction of the taper alternating from one tapered load plate to the next to account for off-center saw cuts.

26 Claims, 16 Drawing Sheets

TAPERED LOAD PLATE FOR TRANSFERRING LOADS BETWEEN CAST-IN-PLACE SLABS

This is a continuation-in-part of application Ser. No. 12/135,780 filed Jun. 9, 2008, which claims priority to application Ser. No. 10/489,380, filed Mar. 12, 2004, now U.S. Pat. No. 7,481,031, which claims priority to PCT Application No. PCT/US02/29200, filed Sep. 13, 2002, which in turn claims priority to U.S. Provisional Application Ser. No. 60/318,838, filed Sep. 13, 2001, all of which are incorporated by reference in their entireties herein.

TECHNICAL FIELD

This invention relates generally to transferring loads between adjacent cast-in-place slabs and more particularly to a system for transferring, across a joint between a first slab and a second slab, a load applied to either slab.

BACKGROUND

Referring to FIG. 1, when a concrete floor slab 100 is first placed and the concrete starts to cure the volume of the concrete decreases causing the slab to shrink (usually on the order of ⅛ of an inch per 20 feet). Concrete has a relatively low strength when in tension. When the internal stresses due to shrinkage 104 reach a point greater then the tensile strength of the concrete, random stress-relief cracks 102 occur.

These random cracks 102 are undesirable as they detract from the performance of the floor slab 100 and reduce its life span. Referring to FIGS. 2A and 2B, a typical method of controlling where these cracks 102 occur is to induce a weakened plane by saw cutting the top surface 200 of the concrete slab 100 into small panels, as depicted by saw cut 202.

Referring to FIG. 3, an undesirable side effect of having the floor slab 100 made up of numerous small sections is that when the floor is loaded, such as with the wheels of a moving fork lift 300, each section of the floor may be deflected 302 relative to its neighbor causing damage 304 to the joint edge, as depicted in FIG. 3.

Referring to FIG. 4, a conventional technique for reducing this type of deflection 302 is to span the joint 400 with steel bars 402 each having a round cross-section. These bars 402 are commonly referred to as dowel bars.

Referring to FIGS. 5A-5C, dowels of this type are typically assembled into a wirework frame 500 that holds the dowels at a desired depth 502 and orientation. This assembly is generally known as a dowel basket.

Using circular-cross-section dowel bars is associated with various drawbacks. For instance, if the dowel bars 402 are misaligned 600 such that they are not oriented totally perpendicular to the joint, the dowel bars 402 can lock the joint 400 thereby undesirably restraining the joint from opening, which in turn may cause random cracks 102.

Referring to FIG. 7, if a concrete floor slab, such as slabs 100-1 or 100-2, tries to move along the line of the joint 400 relative to the next panel (for instance due to shrinkage or thermal contraction), the dowel bars 402 will restrain this type of movement 700, thereby causing random cracks 102.

Referring to FIG. 8, at an intersection of two joints, movement 800, which is a combination of the two types of movement discussed above in connection with FIGS. 6 and 7, can cause a situation known as corner cracking 802.

Referring to FIGS. 9A and 9B, the round-dowel-bar drawbacks discussed above have been addressed in the past by using dowel bars 900 having a square or rectangular cross-section in conjunction with a plastic or steel clip 902 that places a compressible material 904 on the two vertical faces of the dowel bar 900. These clips 902 produce a void in the concrete wider than the dowel bar 900 allowing for sideways movement and a slight degree of misalignment. The clips 902, however, undesirably add to the expense associated with using dowel bars 900 having square and/or rectangular cross-sections. A more cost-effective solution that overcomes the misalignment problem to a greater extent, therefore, would be advantageous.

Under certain conditions, such as outdoor applications, concrete slab placement should be able to withstand concrete expansion, which is typically due to thermal changes, such as colder winter temperatures changing to warmer summer temperatures. Referring to FIG. 10, conventionally, a piece of compressible material 1000, such as foam, fiberboard, timber, or the like, is placed in an expansion joint 1002 between concrete slabs 100-1 and 100-2. A round-cross-section dowel bar 402 and an end cap 1004 may be used for transferring a load across the expansion joint 1002. As the slabs 100 expand, they move together, as indicated by arrows 1006, the joint 1002 closes, and the dowel bar 402 goes farther into the end cap 1004. This use of round-cross-section dowel bars, however, is associated with the misalignment drawback discussed above in connection with saw-cut control joints. A cost-effective way of dealing with the misalignment situation while transferring loads between concrete slabs across expansion joints 1002 would therefore be desirable.

Applicants' U.S. Pat. No. 6,354,760 discloses a load plate that overcomes the drawbacks discussed above, namely misalignment and allowing relative movement of slabs parallel to the joint. Referring to FIG. 11, the '760 patent discloses using a load plate 1100 rotated such that the load plate has a widest portion (i.e., opposite corners) of the load plate positioned in the joint between slabs 100-1 and 100-2. Using such a load plate 1100 at a construction joint works well because the load plate can be reliably centered at the construction joint between the slabs 100.

A load plate 1100 is not, however, ideally suited for use at saw-cut control joints. As described above, this type of joint results from cracking induced by a saw cut in the upper surface of a concrete slab. The saw cut may be off center with respect to any load plate embedded within the cement, as shown by the dashed line 1200 in FIG. 12. If the saw cut and joint are off-center, the load plate will not function as intended because more than half of the load plate will be fixed within one of the slabs and less than half of the load plate will be available for transferring loads to and from the other slab. Another situation for which a load plate 1100 is not ideally suited is when a construction joint, formed by an edge form, for instance, is expected to be relatively wide open. Under such circumstances, an undesirably large area of load plates 1100 may undesirably be removed from slabs on either or both sides of the joint thereby reducing the ability of the load plate 1100 to transfer loads between the slabs. For these reasons, a load transfer device that provides the advantages of the load plate of the '760 patent and that is well suited to use in saw-cut control joints and construction joints, which may become relatively wide open, would be desirable.

SUMMARY

In accordance with an illustrative embodiment of the invention, a tapered load plate may be used to transfer loads across a joint between adjacent concrete floor slabs. The top and bottom surfaces may taper from approximately 4 inches wide to a narrow substantially pointed end 1308 over a length of approximately 12 inches. As will be apparent, other suitable tapered shapes and/or other suitable dimensions may also be used.

A tapered load plate, in accordance with an illustrative embodiment of the invention, advantageously accommodates misalignment of a saw cut for creating a control joint. Misalignment up to an angle substantially equal to the angle of the load plate's taper may be accommodated.

The tapered shape of the tapered load plate advantageously accommodates differential shrinkage of cast-in-place concrete slabs. When adjacent slabs move away from each other, the narrow end of the tapered load plate moves out of the void that it created in the slab. As the tapered load plate retracts, it will occupy less space within the void in the slab thus allowing the slabs to move relative to one another in a direction parallel to the joint.

Tapered load plates may be assembled into a load-plate basket with the direction of the taper alternating from one tapered load plate to the next. If a saw cut, used for creating a control joint, is positioned off-center relative to the tapered load plates, the alternating pattern of tapered load plates in the load-plate basket will ensure that the cross section of tapered load plate material, such as steel, spanning the joint remains substantially constant across any number of pairs of tapered load plates. For use in connection with a construction joint, an edge form may be used to position tapered load plates before the slabs are cast in place.

In accordance with an illustrative embodiment of the invention, a tapered load plate that comprises a main plate and at least one extension may be used to provide load transfer across an expansion joint. In one embodiment, a first end of the extension is adjacent to the first end of the main plate and configured to be operatively connected to, such as received within, the first concrete slab. The second end of the extension may be adjacent to the second end of the main plate and configured to be operatively connected to an adjacent second slab. Upon being operatively connected to the main plate, a side of the extension may taper as it traverses from the first end to the second end of the extension, such that one side of the extension is not parallel with the other side, wherein a tapered load plate is formed in which the main plate and the extension are configured to span a joint between the first and second slabs and move together.

The tapered shape of the load plate may allow for misalignment. As either or both slabs expand and thereby cause the joint to close, the wide end of the tapered load plate may move farther into the end cap. This results in the allowance of an increasing amount of lateral movement between the slabs parallel to the joint to the central and relatively wider portions of the tapered load plate occupying less space in the tapered void.

In one embodiment, an extension may comprise a covering or sheath configured to receive a main plate. In further embodiments, the covering or sheath may be configured to include a second extension. In further embodiments, the extension may comprise a securing means configured to be operatively connected to a side of the main plate. In certain embodiments, the securing structure may an arm that extends away from a top surface of the extension and an arm that extends from the bottom surface of the extension. The arms may comprise a resilient material.

In accordance with an illustrative embodiment of the invention, a tapered-load-plate basket may be used to position the tapered load plates and compressible material before the concrete slabs are cast in place.

Additional features and advantages of the invention will be apparent upon reviewing the following detailed description.

DETAILED DESCRIPTION

Figure 13:
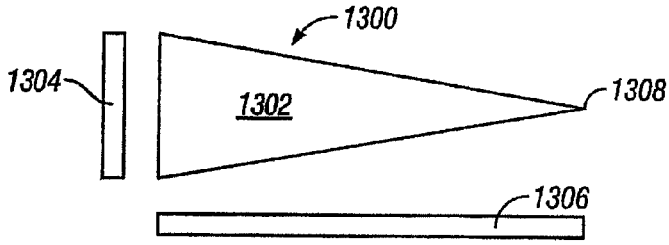
FIG. 13 shows a top and two side views of a tapered load plate in accordance with an illustrative embodiment of the invention.

Referring to FIG. 13, in accordance with an illustrative embodiment of the invention, a tapered load plate, such as tapered load plate 1300, may be used to transfer loads across a joint between adjacent concrete floor slabs. The tapered load plate 1300 may have top and bottom surfaces that are tapered, substantially planar, and substantially parallel to one another. A triangular-shaped tapered top surface 1302 and two generally rectangular-shaped side surfaces 1304 and 1306 are shown in FIG. 13. The top and bottom surfaces may taper from approximately 4 inches wide to a narrow substantially pointed end 1308 over a length of approximately 12 inches. As will be apparent, other suitable tapered shapes and/or other suitable dimensions may also be used.

Figure 14:
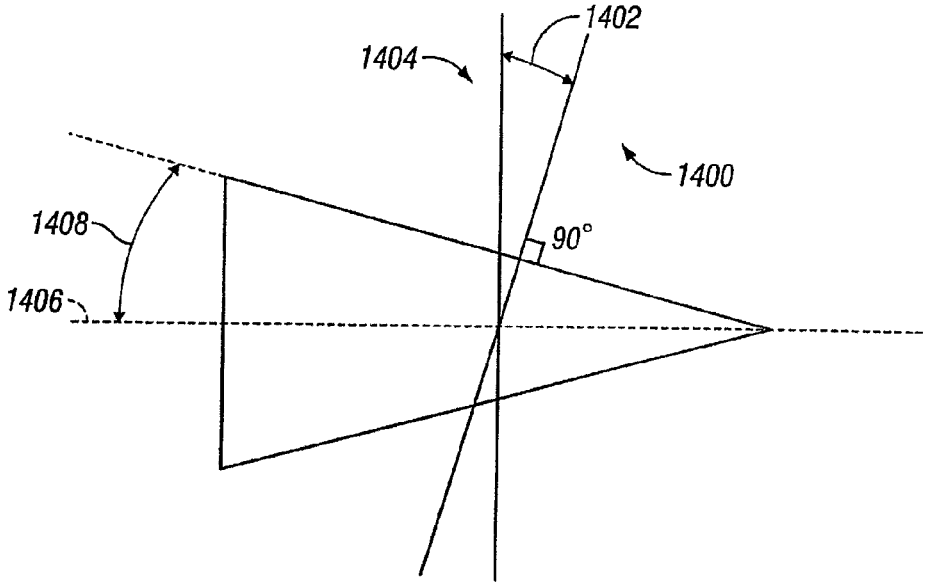
FIG. 14 is a planar view showing a misaligned saw cut relative to a tapered load plate.

A tapered load plate 1300, in accordance with an illustrative embodiment of the invention, advantageously accommodates misalignment of a saw cut for creating a control joint. Misalignment up to an angle substantially equal to the angle of the load plate's taper may be accommodated. Referring to FIG. 14, a misaligned saw cut 1400 is misaligned by an angle 1402 from correctly aligned saw cut 1404, which is oriented perpendicular to the tapered load plate's longitudinal axis 1406. The load plate's angle of taper is depicted in FIG. 14 by angle 1408.

Figure 15:
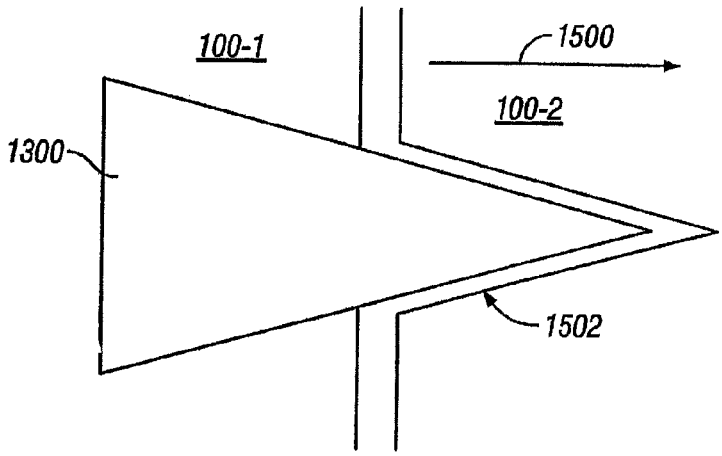
FIG. 15 is a planar view of a tapered load plate, two slabs, a joint, and a void created by the narrow end of the tapered load plate.

Referring to FIG. 15, differential shrinkage of cast-in-place concrete slabs is advantageously accommodated by the tapered shape of the tapered load plate 1300. When adjacent slabs, such as slabs 100-1 and 100-2, move away from each other, as indicated by arrow 1500, the joint 400 is said to open. As this occurs, the narrow end of the tapered load plate 1300 moves out of the void 1502 that it created in the slab 100-2. As the tapered load plate 1300 retracts in this manner, it will occupy less space within the void in the slab 100-2 thus allowing the slabs 100-1 and 100-2 to move relative to one another in a direction parallel to the joint 400. In other words, as the slabs move apart, the narrow end of the tapered load plate occupies less of the width of the tapered void 1502.

Figure 16:
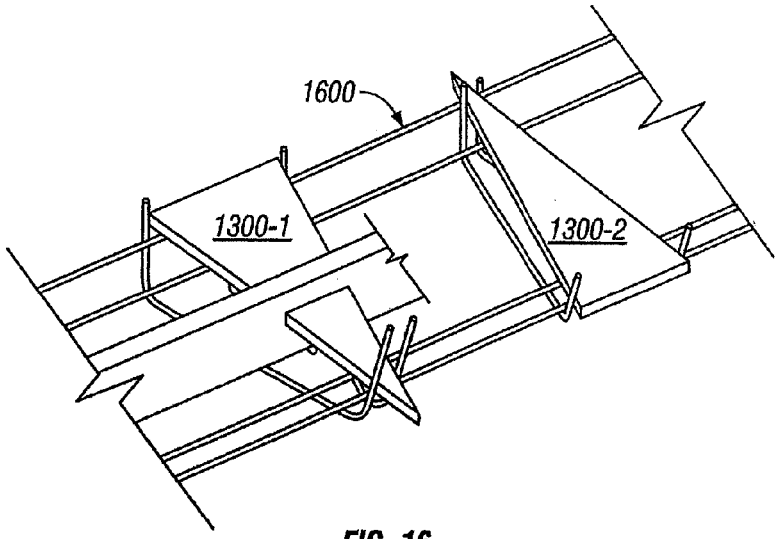
FIG. 16 shows tapered load plates in a tapered-load-plate basket, wherein the orientation of the tapered load plates alternates from one tapered load plate to the next.
Figure 17:
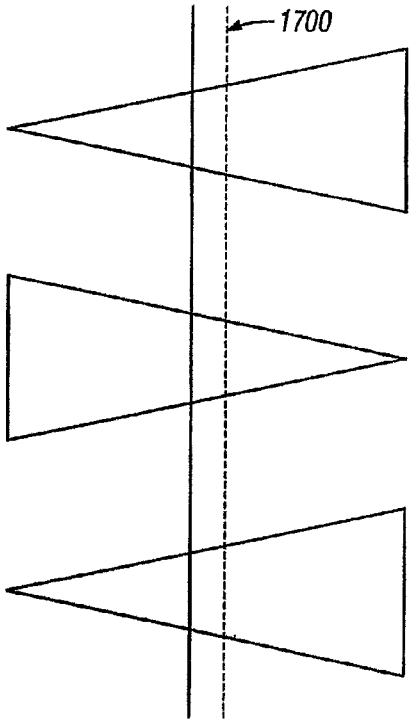
FIG. 17 is a planar view showing an off-center saw cut relative to three alternately oriented tapered load plates.

Referring to FIG. 16, tapered load plates 1300 may be assembled into a load-plate basket 1600 with the direction of the taper alternating from one tapered load plate 1300 to the next. Referring to FIG. 17, if a saw cut 1700, used for creating a control joint, is positioned off-center relative to the tapered load plates 1300, the alternating pattern of tapered load plates 1300 in the load-plate basket 1600 will ensure that the cross section of tapered load plate material, such as steel, spanning the joint remains substantially constant across any number of pairs of tapered load plates 1300. For use in connection with a construction joint, an edge form may be used to position tapered load plates before the slabs are cast in place.

Figure 1:
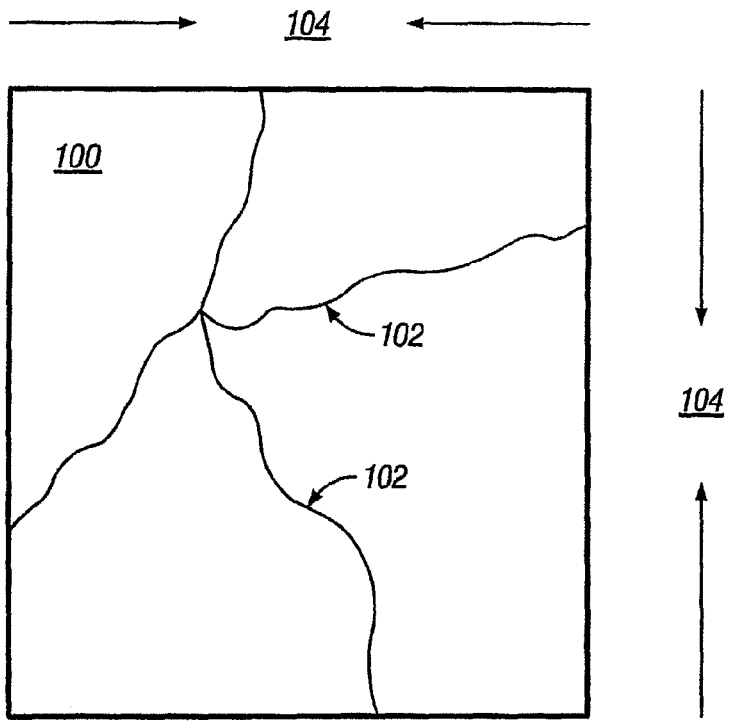
FIG. 1 PRIOR ART
FIG. 1 is a planar view of a concrete floor slab with random cracks caused by concrete shrinkage.
Figure 2A:
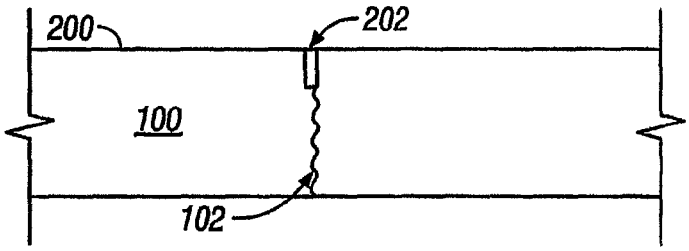
FIG. 2A PRIOR ART
FIGS. 2A and 2B are cross-section and planar views of saw-cut control joints.
Figure 2B:
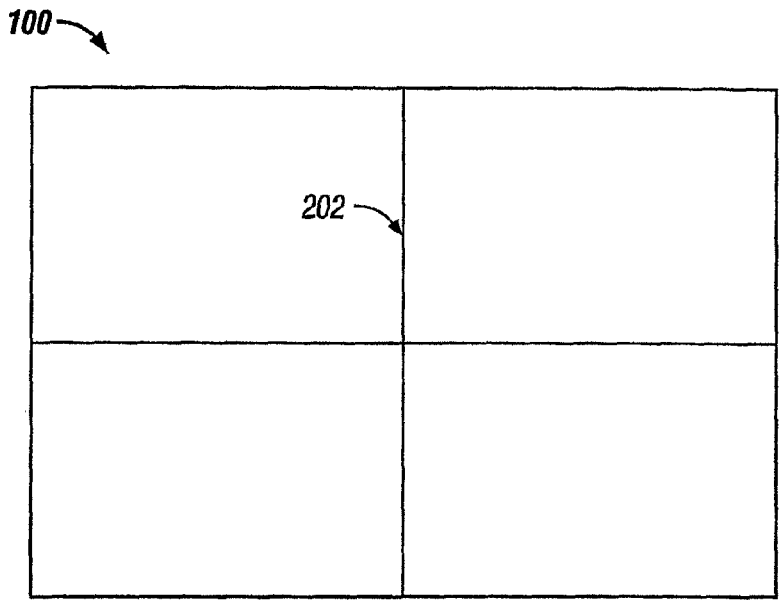
FIG. 2B PRIOR ART
Figure 3:
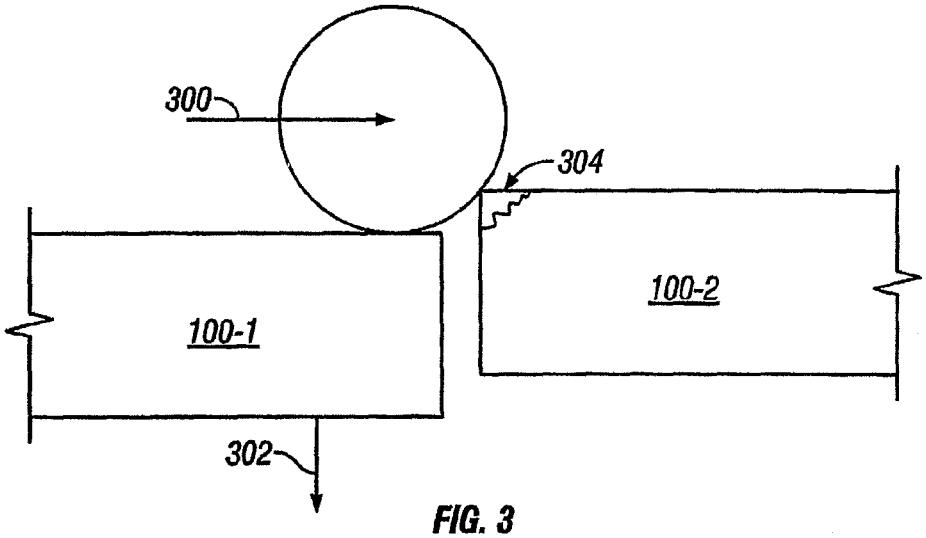
FIG. 3 PRIOR ART
FIG. 3 depicts vertical deflection of a floor slab under a load and damage to an adjacent floor slab.
Figure 4A:
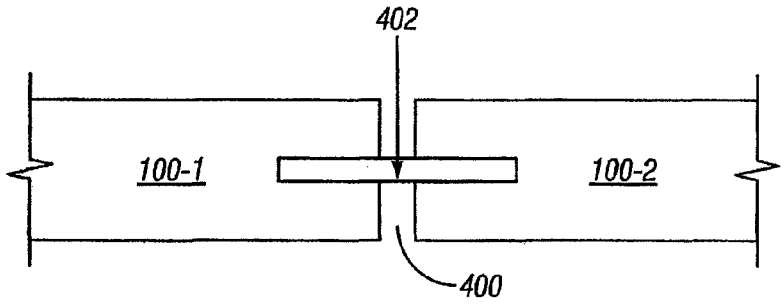
FIG. 4A PRIOR ART
FIGS. 4A and 4B are cross section and planar view of dowel bars positioned for transferring loads across joints between adjacent slabs.
Figure 4B:
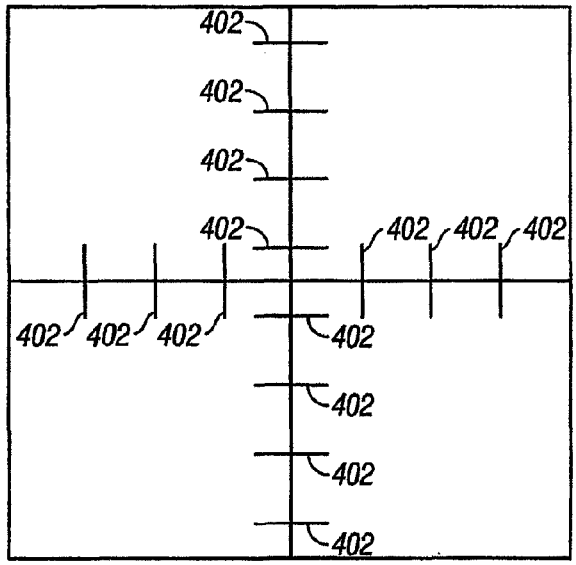
FIG. 4B PRIOR ART
Figure 5A:
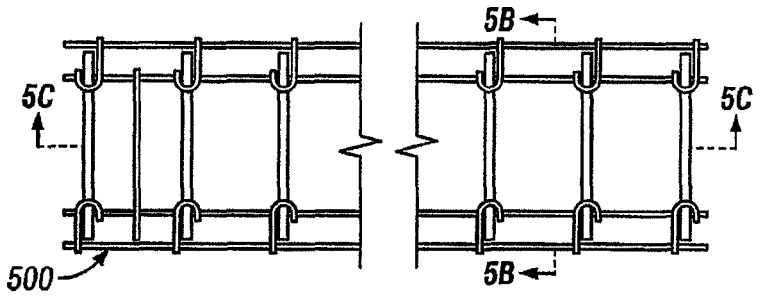
FIG. 5A PRIOR ART
FIGS. 5A-5C are planar and sectional views of a dowel basket for positioning dowel bars before a floor slab is cast in place.
Figure 5B:
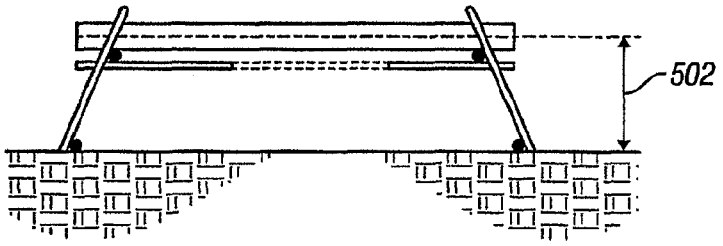
FIG. 5B PRIOR ART
Figure 5C:
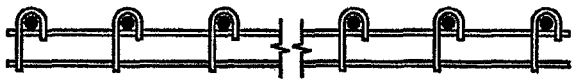
FIG. 5C PRIOR ART
Figure 6:
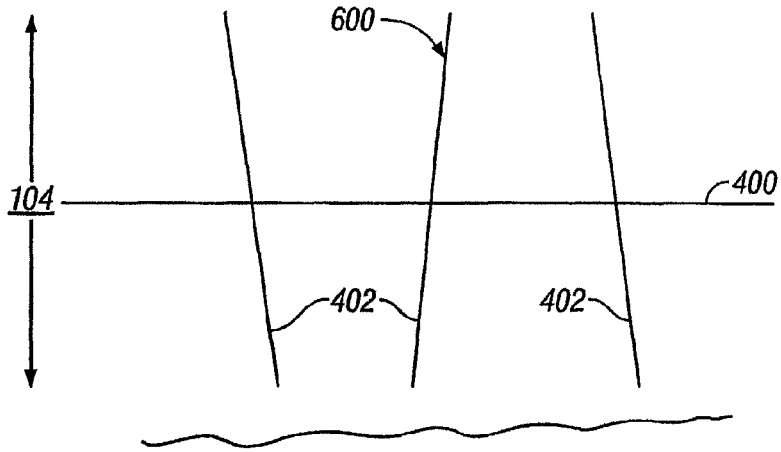
FIG. 6 PRIOR ART
FIG. 6 is a planar view of misaligned dowel bars locking a joint and thereby causing a slab to crack.
Figure 7:
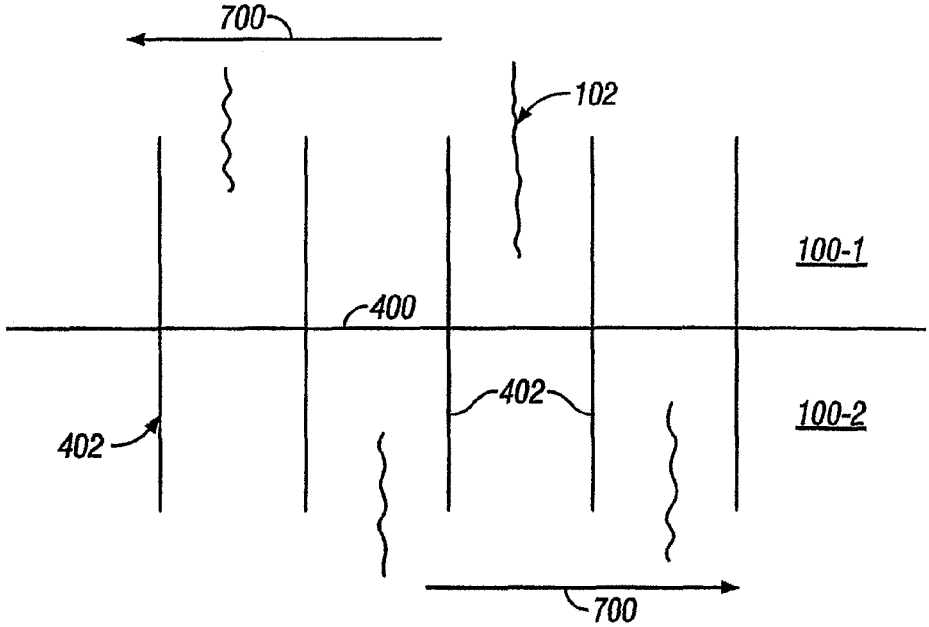
FIG. 7 PRIOR ART
FIG. 7 is a planar view of cracks caused by dowel bars restricting relative movement of slabs parallel to the joint between the slabs.
Figure 8:
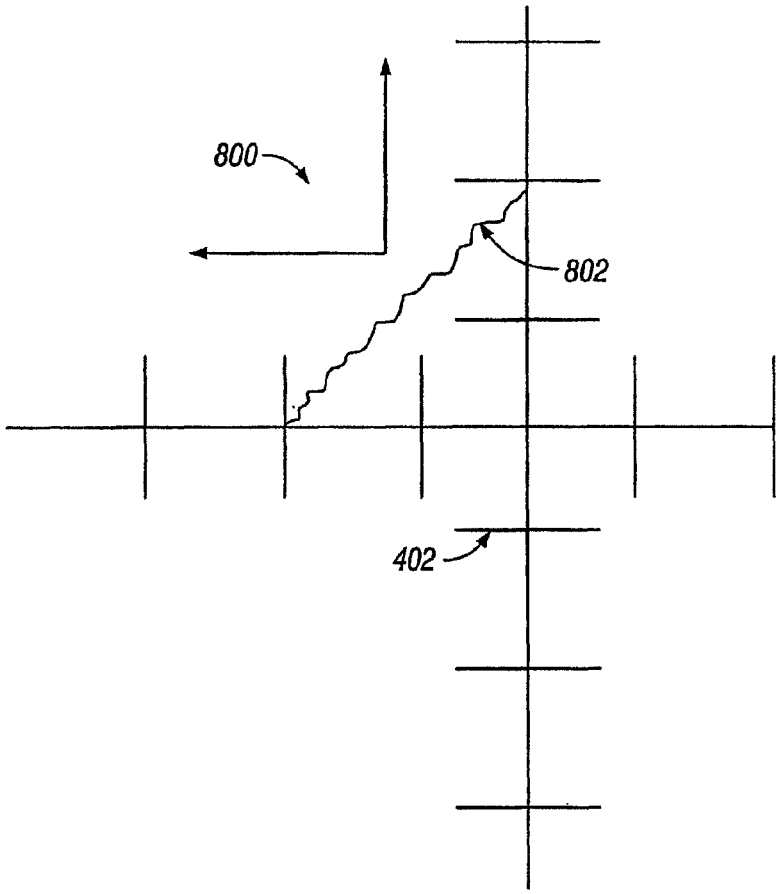
FIG. 8 PRIOR ART
FIG. 8 is a planar view showing corner cracking due to misaligned dowel bars and restricted relative movement of slabs parallel to the joints.
Figure 9A:
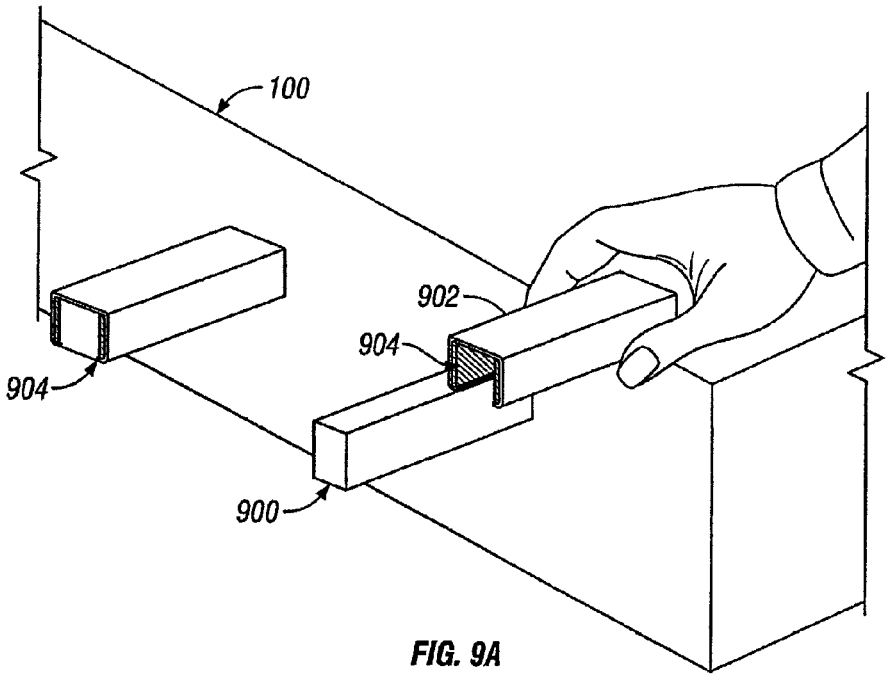
FIG. 9A PRIOR ART
FIGS. 9A and 9B are isometric and sectional views of a square dowel and square-dowel clip.
Figure 9B:
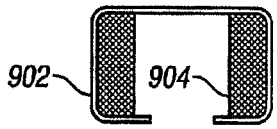
FIG. 9B PRIOR ART
Figure 10:
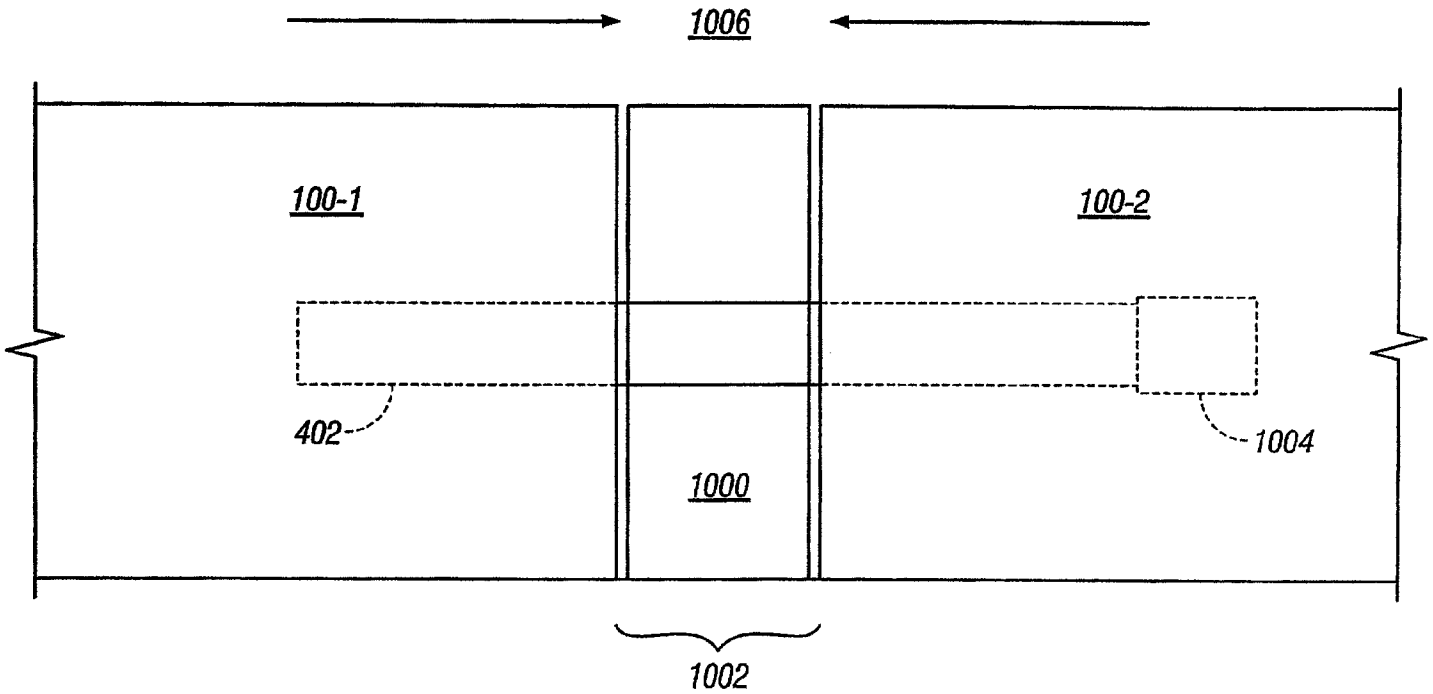
FIG. 10 PRIOR ART
FIG. 10 is a side view of a typical expansion joint with compressible material in the joint.
Figure 11:
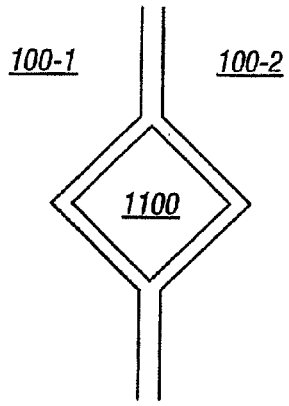
FIG. 11 PRIOR ART
FIG. 11 is a planar view of a diamond-shaped load plate between two slabs.
Figure 12:
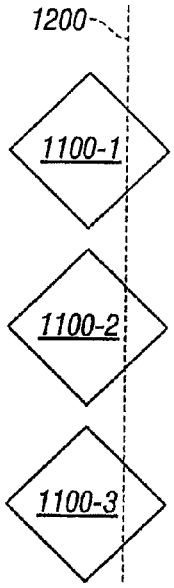
FIG. 12 PRIOR ART
FIG. 12 is a planar view illustrating an off-center saw cut relative to diamond-shaped load plates.
Figure 18:
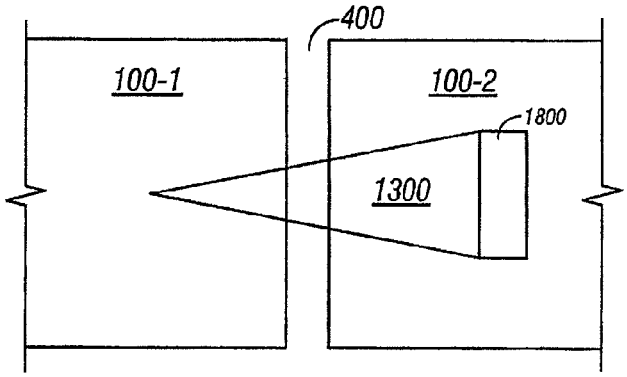
FIG. 18 is a planar view of an open expansion joint, a tapered load plate, and an end cap.
Figure 19:
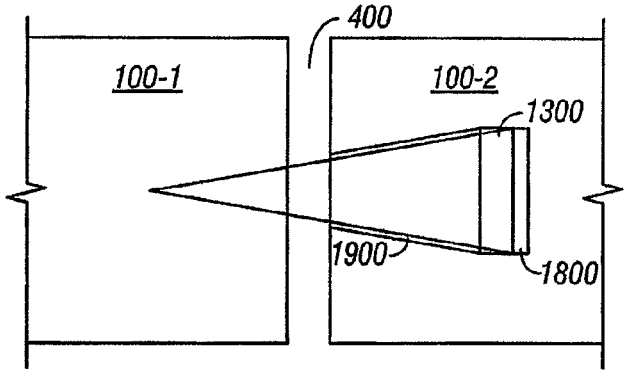
FIG. 19 is a planar view similar to FIG. 18 with the joint having closed relative to FIG. 18.

Referring to FIG. 18, in accordance with an illustrative embodiment of the invention, a tapered load plate 1300 and an end cap 1800 may be used to provide load transfer across an expansion joint of the type discussed above in connection with FIG. 10. The tapered shape of the load plate 1300 will allow for misalignment, as discussed above in connection with FIG. 14. As either or both slabs 100-1 and 100-2 expand and thereby cause the joint 400 to close, the wide end of the tapered load plate 1300 moves farther into the end cap 1800. This results in the allowance of an increasing amount of lateral movement between the slabs 100-1 and 100-2 parallel to the joint 400 due to the central and relatively wider portions of the tapered load plate occupying less space in the tapered void 1900 (FIG. 19).

Figure 20:
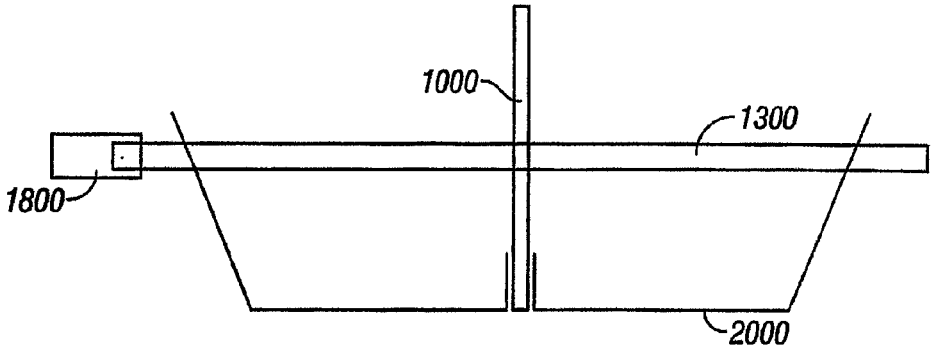
FIG. 20 is a side view of an expansion-type tapered-load-plate basket, compressible material, a tapered load plate, and an end cap.

Referring to FIG. 20, in accordance with an illustrative embodiment of the invention, a tapered-load-plate basket 2000 may be used to position the tapered load plates 1300 and compressible material 1000 before the concrete slabs 100 are cast in place.

Figure 21A:
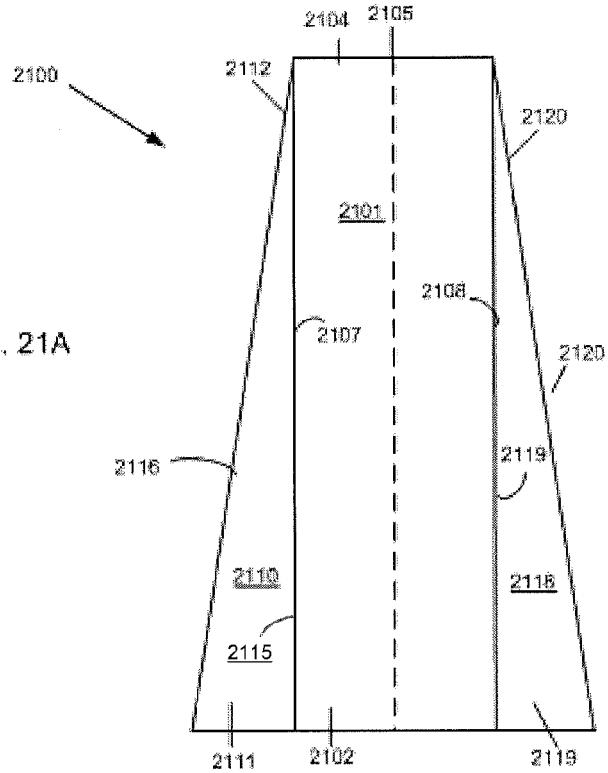
FIG. 21 is a planar view of an additional embodiment of a tapered load plate.
Figure 21B:
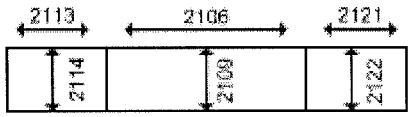

Referring to FIG. 21, in accordance with another embodiment of the invention, a tapered load plate 2100 may have a desired shape, and be constructed of two or more materials. As shown in FIGS. 21A and 21B, exemplary load plate 2100 may include a central, somewhat tapered or even substantially rectangular plate (see main plate 2101). In one embodiment, main plate 2101 comprises a substantially rigid material, such as steel that may be load-bearing. In one embodiment, main plate 2101 may be constructed to transfer between two concrete slabs a load applied to either of the slabs directed substantially perpendicular to an upper surface of one of the slabs. Those skilled in the art with the benefit of this disclosure will readily appreciate that other materials, whether used in conjunction with or independently of steel, may be used without departing from the scope of this disclosure. In one embodiment, main plate 2101 may be similar in composition to plate 1300.

Main plate 2101 comprises a first end 2102 and a second end 2104 across a longitudinal axis (represented by dashed line 2105). In the illustrated embodiment, the width of the first end 2102 (shown by double arrow 2106 of FIG. 21B) is substantially the same as the width of the second end 2104. Thus, sides 2107 and 2108 are substantially parallel and plate 2101 is substantially rectangular. In other embodiments, however, the width of the plate 2101 may not be uniform as the longitudinal axis 2105 is traveled from the first end 2102 to the second end 2104. In one embodiment, the width 2106 of the first end 2102 may be narrower than the width at the second end 2104. In one such embodiment, the resulting shape may comprise a triangle-like structure. Other shapes, including a rectangular, cylindrical, and/or trapezoidal are contemplated to be within the scope of this disclosure. As explained in more detail below, however, the tapering of at least one side 2107 or 2108 of plate 2101 may be less tapered (with reference to the longitudinal axis 2105) than the resulting angle of an outer edge or side of an attached fin or extension (described immediately below) that is attached to that at least one side 2107, 2108 of the plate 2101.

As best seen in FIG. 21B, main plate 2101 is also shown to have a vertical depth (see element 2109). Those skilled in the art will readily appreciate that the depth 2109 of the plate 2101 may vary along the longitudinal axis 2105 and/or along a latitudinal direction. Further, those skilled in the art with the benefit of this disclosure will readily appreciate that the term "side" is not limited to a wall or uniform structure, but rather defines a boundary. For example, a ridge or protrusion may form at least a portion of a side of one or more structures discussed within this disclosure. One exemplary embodiment of such a side is discussed below in relation to FIGS. 23 A and 23B.

Exemplary plate 2100 may further comprise a first extension (or fin) 2110 having a first end 2111 and a second end 2112 separated along the longitudinal direction 2105. (The width and depth of the first end 2111 is shown as double arrows 2113 and 2114, respectively). First extension 2110 may be constructed to be less rigid than plate 2101, such that it is deformable under a pressure that would not deform plate 2101. In one embodiment, first extension 2110 comprises a second material that is not present within the main plate 2101. Yet in other embodiments, first extension 2110 comprises a second material that is present in different quantities and/or proportions in the first extension 2110 than within the main plate 2101. In one embodiment, the first extension 2110 comprises a compressible material, such as foam, fiberboard, rubber, or combinations thereof, thereby allowing first extension 2110 to be more compressible than the main plate 2101. Those skilled in the art will appreciate that other materials, whether used in conjunction with or independently of a compressible material may be used without departing from the scope of this disclosure. In other embodiments, first extension 2110 comprises a rigid, load-bearing component. In one embodiment, first extension 2110 may comprise steel.

First extension 2110 further comprises a first side 2115 that is configured to be secured to side 2107 of the main plate 2101. In one embodiment, the first side 2115 is permanently secured and/or bonded to side 2107 of the main plate 2101 through mechanical and/or chemical means, such as screws, rivets, nails, heating, latches, ties, glues (adhesives), and combinations thereof. In other embodiments, first side 2115 is removably secured and/or bonded to side 2107 of main plate 2101. In certain embodiments, allowing first extension 2110 to be removably secured to main plate 2101 may allow the plate 2100 to be constructed on-site with different sized and/or shaped extensions 2110 being attachable to the main plate 2101.

As shown in the exemplary embodiment of FIG. 21A, side 2116 forms an outer edge of plate 2100 and is at an acute angle, and thus off-axis, with respect to the longitudinal axis 2105. In this regard, side 2116 is more off-axis than side 2107. Thus, attaching first extension 2110 to the main plate 2101 causes at least a portion of plate 2100's tapered shape. While the second end 2112 of first extension 2110 is shown as being substantially "tip-shaped," there is no requirement that the second end 2112 must terminate in a tip. Rather, as long as the width of the second end 2112 is shorter than the width 2113 of the first end 2111, such that the second side 2116 is off axis, and thus not parallel to the first side 2115, then the first extension is said to be tapered. In one embodiment, second side 2116 is off-axis to the first side 2115 by at least 1 degree. Yet in another embodiment, second side 2116 is off-axis to the first side 2115 by at least 5 degrees. Yet in another embodiment, second side 2116 is off-axis to the first side 2115 at about 45 degrees.

Exemplary plate 2100 may comprise a second extension (or fin), such as second extension 2118. Similar to the first extension 2110, second extension 2118 has a first end 2119 and a second end 2120 separated along the longitudinal direction 2105. (The width and depth of the first end 2119 is shown as double arrows 2121 and 2122, respectively). As shown, second extension 2118 comprises a first side 2119 that is in operatively connected with side 2108 of the main plate 2101. As used herein, "operatively connected" is used to refer to direct connections as well as indirect connections, such as through a separate seal, gasket, or any other separate component that may be placed between the extension and the main plate. As discussed above in relation to the first extension 2110, first side 2119 may be permanently or removably secured and/or bonded to side 2108 of the main plate 2101 through mechanical and/or chemical means.

Side 2120, which forms an outer edge of the second extension 2118 (and of plate 2100) is at an acute angle, and thus off-axis, with respect to the longitudinal axis 2105. In the exemplary embodiment shown in FIG. 21A, side 2120 tapers towards the longitudinal axis 2105 at about the same angle that side 2116 of the first extension 2110 tapers towards the longitudinal axis 2105, however this is merely one exemplary embodiment. In one embodiment, each side 2116, 2120 tapers towards the longitudinal axis at a different angle. Additionally, there is no requirement that widths 2113, 2121 or depths 2114, 2122 be substantially the same. Further, there is no requirement that more than one extension 2110, 2118 be attached to main plate 2101. In certain embodiments in which more than one extension is attached (or attachable) to main plate 2101, each extension 2110, 2118 may have a unique composition, and thus be formed of different materials or have different proportions of the same materials.

Figure 22A:
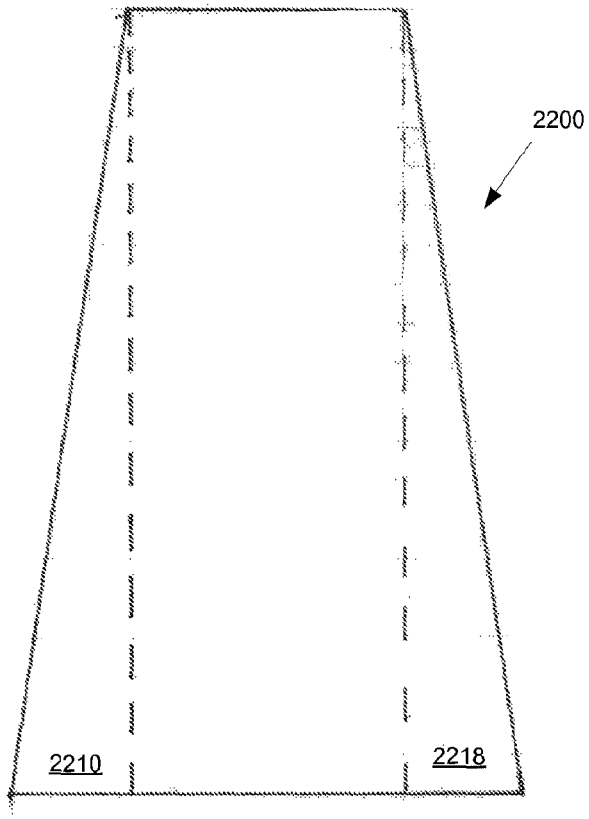
FIG. 22 is a planar view of another additional embodiment of a tapered load plate.
Figure 22B:
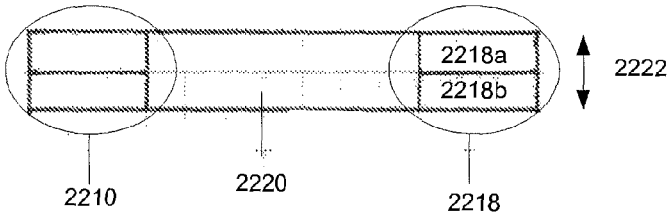

Referring to FIGS. 22A and 22B, in accordance with a further embodiment of the invention, a sheath or covering 2200 may be configured to receive a main plate, such as main plate 2101 shown in FIGS. 21A and 21B. In one embodiment, covering 2200 may contain or house one or more extensions, such as first extension 2210 and/or second extension 2218, which may, in certain embodiments, resemble extensions 2110 and 2118 shown in FIGS. 21A and 21B, respectively. Covering 2200 may be formed of any suitable material. In one embodiment, covering 2200 comprises a molded plastic or rubber material. Yet in other embodiments, covering 2200 may comprise a substantially rigid, inflexible material, such as steel.

Referring to FIGS. 22A and 22B, in accordance with a further embodiment of the invention, a sheath or covering 2200 may be configured to receive a main plate, such as main plate 2101 shown in FIGS. 21A and 21B. In one embodiment, covering 2200 may contain or house one or more extensions, such as first extension 2210 and/or second extension 2218, which may, in certain embodiments, resemble extensions 2110 and 2118 shown in FIGS. 21A and 21B, respectively. Covering 2200 may be formed of any suitable material. In one embodiment, covering comprises a molded plastic or rubber material. Yet in other embodiments, covering 2200 may comprise a substantially rigid, inflexible material, such as steel.

Covering 2200 is not required to be uniform and/or create an entire outer surface. In one embodiment, covering 2200 may form at least part of one or more extensions 2210 and/or 2218 to provide a desired shape for a tapered load plate. In certain embodiments, covering 2200 may be a shell, sheath, frame, and/or combinations thereof. The extensions 2210/2218 may comprise one or more inward projections and confine a plate, such as main plate 2101 at about a desired location, once inserted into channel 2220. In certain embodiments, covering 2200 may contain or be configured to receive a plurality of different components to form a single extension. For example, extension 2218 may be formed of a first component 2218*a* and a second component 2218*b*. In one embodiment, the components may be joined together to form a laminate material. In one embodiment, first component 2218*a* and second component 2218*b* are configured, once positioned within covering 2200, to flex in a vertical direction (i.e., along arrow 2222) without breaking to transfer stress loads from a concrete slab in operative connection with the first end of a load plate housed within channel 2220 and a concrete slab in operative connection with the second end of the load plate within channel 2220.

While only two components (2218*a*, 2218*b*) are shown in FIG. 22B as forming extension 2218, those skilled in the art will readily understand that fewer or a greater amount of components may be utilized. The components (i.e., 2218*a*, 2218*b*) may be held together through the assistance of one or more mechanical or chemical structures, including but not limited to: rivets, welds, bolts, screws, nails, and/or glues (adhesives). In certain embodiments, covering 2200 may be configured to contribute to the flexing properties of the components 2218*a*/2218*b*. The components 2218*a*/2218*b* of extension 2218 may be partially or entirely different than one or more components of extension 2210. Moreover, in other embodiments, a main plate (i.e. main plate 2101) may be irremovably secured within channel 2220 and only extensions 2210 and/or 2218 may be adjusted and/or removed.

Figure 23A:
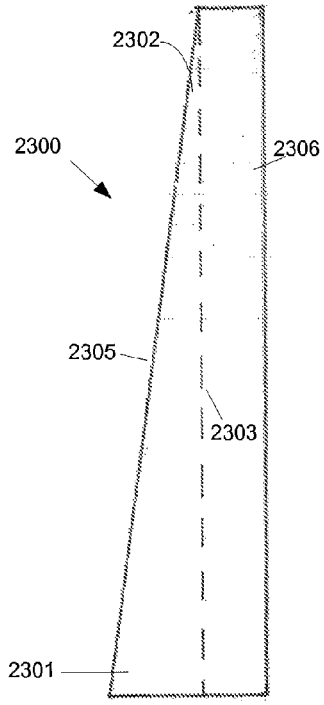
FIG. 23 is a planar view of yet another additional embodiment of a tapered load plate.
Figure 23B:
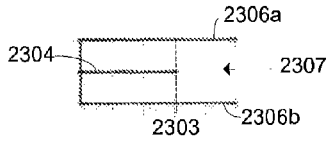

FIG. 23 shows an exemplary extension that may be used in accordance with yet another embodiment of the invention. Specifically, FIG. 23A shows a top view of exemplary extension 2300 and FIG. 23B shows a side view of exemplary extension 2300. Looking first to FIG. 23A, extension 2300 having a first end 2301 and a second end 2302 which may be separated along a longitudinal axis (not shown, but can be, in certain embodiments, considered to be substantially parallel with dotted line 2105 shown in FIG. 21A). As shown, extension 2300 comprises a first side (shown as the dotted line 2303) that is configured to be placed against (either removably or irremovably) a main plate, such as main plate 2101. In one embodiment, first side 2303 comprises a "wall-like" structure that abuts directly against the side of a main plate 2101. In other embodiments, a protrusion, such as protrusion 2304 may create the boundary which defines the side 2303. Protrusion 2304 may comprise a substantially rigid material, yet in other embodiments, protrusion 2304 comprises a substantially compressible material. In one embodiment, the protrusion's 2304 composition is substantially similar to another portion, or the remainder, of extension 2300.

Extension 2300 further comprises a second side 2305 which forms an outer edge of the extension 2300. As seen in the exemplary embodiment shown in FIG. 21A, side 2305 tapers towards (and thus is off-axis and not parallel to) side 2303. In certain embodiments, the composition of the extension 2300 within sides 2303 and 2305 may substantially similar to extensions 2110, 2118 (FIG. 21), and/or extensions 2210, 2218 (FIG. 22).

Extension 2300 may further comprise a securing structure, such as securing structure 2306. In the illustrated embodiment best shown in FIG. 23B, securing structure 2306 may comprise one or more arms 2306*a*, 2306*b*, which creates a receiving cavity 2307. The securing structure 2306 is configured to secure (either removably or irremovably) extension 2300 to a plate, such as main plate 2101 (shown in FIGS. 21A and 21B). Main plate 2101 may be received in receiving cavity 2307, in which either side 2303 and/or protrusion 2304 defines the boundary to which the main plate 2101 is received. In one embodiment, one or more of the resilient arms 2306*a*, 2306*b* may be a resilient arm. In those embodiments, resilient arm 2306*a* may be configured to be positioned over a top portion of a plate, such as main plate 2101, and resilient arm 2306*b* may be configured to be positioned over a bottom portion of main plate 2101. Those skilled in the art, with the benefit of this disclosure, will readily appreciate that the securing structure may have one or more grooves, protrusions, or other structures that assist with the attachment of the securing structure 2306 to the main plate 2101. In further embodiments, main plate 2101 may comprise a securing structure, which may resemble securing structure 2306. Thus, in certain embodiments, extension 2300 may be shaped to fit within a cavity formed by a securing structure on main plate 2101. Further, while FIG. 23A shows securing structure 2306 as a flat straight rectangular structure, those skilled in the art, with the benefit of this disclosure, will understand that it is merely one illustrative embodiment, and that the securing structure 2306 may be of several different shapes and/or sizes without departing from the scope of this disclosure.

Figure 24:
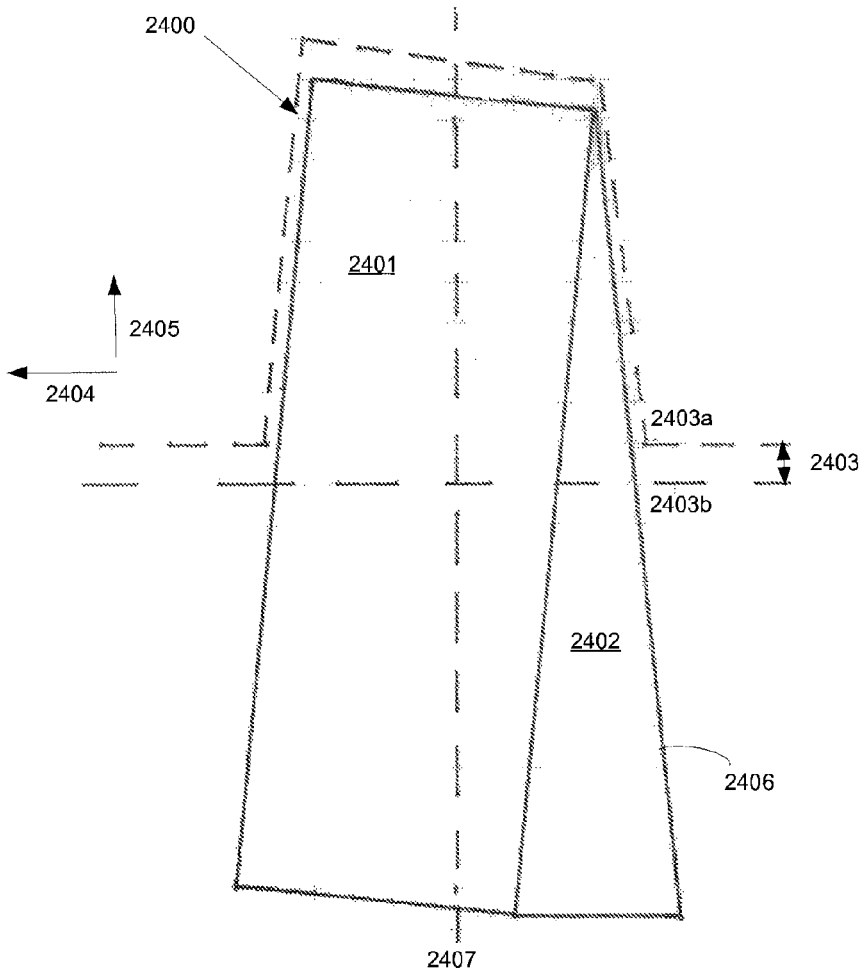
FIG. 24 is a planar view of yet another additional embodiment of a tapered load plate

FIG. 24 shows an exemplary tapered load plate 2400 according to one embodiment of the invention. Tapered load plate 2400 comprises a main plate 2401 and extension 2402. As shown main plate 2401 is secured to extension 2402 within a joint 2403. At least a portion of joint 2403 may be created by a first boundary 2403*a* at a first piece of concrete and a second boundary 2403*b* at a second piece of concrete that may be positioned substantially parallel to each other along a latitudinal axis (see arrow 2404). In one embodiment, main plate 2401 is formed from suitable materials as to be load bearing during normal use. In one embodiment, main plate 2401 comprises steel. Extension 2402 may be formed from suitable materials to form a structural addition to extension 2402, such that upon movement of tapered load plate 2400 along direction 2304 or direction 2305, the main plate 2401 and extension 2402 move together. In one embodiment, extension 2402 may be formed from suitable materials as to be load bearing during normal use. In one embodiment, extension 2402 comprises steel. In one embodiment, extension 2402 may comprise compressible materials. In one embodiment, upon attachment of extension 2402 to main plate 2401, the outer edge 2406 of the extension is configured to be substantially parallel with a longitudinal axis (for example, dotted line 2407) that is substantially perpendicular to the boundaries of two adjoining concrete slabs.

While the invention has been described with respect to specific examples including presently preferred modes of carrying out the invention, the invention is limited only by the following claims.

We claim:

1. A system for restricting certain movement, accommodating certain other movement and transferring loads between a first concrete on-ground cast-in-place slab and a second concrete on-ground cast-in-place slab, the system comprising the slabs and further comprising:

a joint interposing the first and second slabs, at least the first slab having a substantially planar upper surface, at least a portion of the joint being initially defined by at least one of a crack, cut or a form oriented substantially perpendicular to the substantially planar upper surface of the first slab, wherein a longitudinal axis of the joint is formed by an intersection of the crack, cut or form and the upper surface of the first slab and wherein the joint is subject to opening through a range of joint opening dimensions and beyond;

a first tapered load plate and a second tapered load plate that each have a taper, protrude into the first and second slabs and have an extent across the joint such that the load plates span the joint and transfer between the first and second slabs a load applied to either of the slabs directed substantially perpendicular to the upper surface of the first slab; the tapered load plates each having a width measured parallel to the longitudinal axis of the joint; the width of each tapered load plate generally tapering from a relatively wide location in the extent of each plate across the joint to a relatively narrow portion such that, as the joint opens, a tapered gap opens between the load plate and the slab near the narrow end portion such that the slabs are allowed increasingly greater relative movement in the direction substantially parallel to the longitudinal axis of the joint; and wherein the first and second tapered load plates are oriented such that for at least the range of joint opening dimensions, reduced width of one load plate at the narrowest width in the joint of the one load plate due to plate taper is compensated for by increased width of the other load plate in the joint due to opposing plate taper, such that for at least the range of joint opening dimensions, the combined widths of the first and second tapered load plates in the joint is consistently adequate for load transfer across the joint;

whereby the tapered load plates restrict relative movement between the first and second slabs in a direction substantially perpendicular to the upper surface of the first slab, allow the joint to open by allowing the first and second slabs to move away from each other in a direction substantially perpendicular to the joint, allow for increasingly greater relative movement in a direction substantially parallel to the longitudinal axis of the joint as the joint opens, and maintain consistently adequate load transfer across the joint;

at least one of the tapered load plates including a main plate portion and at least one extension, the main plate portion comprising a first end, a second end, and at least a first main plate portion side extending from between at least adjacent the first end and at least adjacent the second end, the first main plate portion side crossing the joint, and the at least one extension comprising at least a first extension side alongside the first main plate portion side.

2. The system of claim 1, wherein both the tapered load plates include main plate portions as in claim 1 and at least one extension also as described in claim 1.

3. The system of claim 1, wherein the tapered load plate that includes a main plate portion and at least one extension also includes a second extension, the main plate portion further comprising a second main plate portion side extending from between at least adjacent the first end and at least adjacent the second end, the second main plate portion side crossing the joint, and the second extension comprising at least a second extension side alongside the second main plate portion side.

4. The system of claim 3, wherein the main plate portion is steel and the at least one extension and the second extension include a material that is more compressible than the main plate portion.

5. The system of claim 1, further comprising a tapered-load-plate basket that positions the tapered load plates before the slabs are cast in place.

6. The system of claim 1 or claim 5, wherein the joint is a saw-cut control joint.

7. The system of claim 1, wherein the main plate portion of the tapered load plate having a main plate portion is steel and the extension includes a material that is more compressible than the main plate portion.

8. Apparatus for use in a system for transferring loads between a first concrete on-ground cast-in-place slab and a second concrete on-ground cast-in-place slab, the system comprising the first and second slabs and a joint interposing the first and second slabs, at least the first slab having a substantially planar upper surface, at least a portion of the joint being initially defined by at least one of a crack, cut or a form oriented substantially perpendicular to the substantially planar upper surface of the first slab, wherein a longitudinal axis of the joint is formed by an intersection of the crack, cut or form and the upper surface of the first slab and wherein the joint is subject to opening through a variety of joint opening dimensions;

the apparatus comprising:

a first tapered load plate and a second tapered load plate that each have a taper, protrude in use into the first and second slabs and have an extent in use across the joint such that the load plates span the joint and transfer between the first and second slabs a load applied to either of the slabs directed substantially perpendicular to the upper surface of the first slab; the tapered load plates each having a width in use measured parallel to the longitudinal axis of the joint; the width of each tapered load plate generally tapering from a relatively wide location in the extent of each plate across the joint to a relatively narrow portion;

whereby in use, as the joint opens, a tapered gap opens between the load plate and the slab near the narrow portion such that the slabs are allowed increasingly greater relative movement in the direction substantially parallel to the longitudinal axis of the joint; and whereby in use the first and second tapered load plates are oriented such that as the joint opens, reduced width of one load plate at the narrowest width in the joint of the one load plate due to plate taper is compensated for by increased width of the other load plate in the joint due to opposing plate taper, such that as the joint opens, the combined widths of the first and second tapered load plates in the joint is substantially consistent for substantially consistent load transfer across the joint; and whereby in use the tapered load plates restrict relative movement between the first and second slabs in a direction substantially perpendicular to the upper surface of the first slab, allow the joint to open by allowing the first and second slabs to move away from each other in a direction substantially perpendicular to the joint, allow for increasingly greater relative movement in a direction substantially parallel to the longitudinal axis of the joint as the joint opens, and maintain substantially consistent load transfer across the joint;

at least one of the tapered load plates including a main plate portion and at least one extension, the main plate portion comprising a first end, a second end, and at least a first main plate portion side extending from between at least adjacent the first end and at least adjacent the second end, the first main plate portion side crossing the joint, and the at least one extension comprising at least a first extension side alongside the first main plate portion side.

9. The system of claim 8, wherein both the tapered load plates include main plate portions as in claim 8 and at least one extension also as described in claim 8.

10. The system of claim 8, wherein the tapered load plate that includes a main plate portion and at least one extension also includes a second extension, the main plate portion further comprising a second main plate portion side extending from between at least adjacent the first end and at least adjacent the second end, the second main plate portion side crossing the joint, and the second extension comprising at least a second extension side alongside the second main plate portion side.

11. The system of claim 10, wherein the main plate portion is steel and the at least one extension and the second extension include a material that is more compressible than the main plate portion.

12. The system of claim 8, further comprising a tapered-load-plate basket that positions the tapered load plates before the slabs are cast in place.

13. The system of claim 8 or claim 12, wherein the joint is a saw-cut control joint.

14. The system of claim 8, wherein the main plate portion of the tapered load plate having a main plate portion is steel and the extension includes a material that is more compressible than the main plate portion.

15. Apparatus for transferring loads between a first concrete on-ground cast-in-place slab and a second concrete on-ground cast-in-place slab, the apparatus for use in a system, the system comprising:

a joint separating first and second slabs, at least a portion of the joint being initially defined by a partial depth saw cut that results in a crack below the saw cut, wherein a longitudinal axis of the partial depth portion of the joint formed by the saw cut is formed by an intersection of the saw cut and the upper surface of the first slab;

the apparatus comprising:

a first load plate and a second load plate that in use each protrude into the first and second slabs such that the load plates transfer between the first and second slabs a load applied to either of the slabs directed substantially perpendicular to the upper surface of the first slab;

whereby the load plates restrict relative movement between the first and second slabs in a direction substantially perpendicular to the upper surface of the first slab, and the load plates allow the joint to open by allowing the first and second slabs to move away from each other in a direction substantially perpendicular to the joint;

the load plates each having a width measured in use parallel to the longitudinal axis of the joint; and wherein the width of each load plate generally tapers from a relatively wide portion near the joint to at least one relatively narrow end in at least one of the slabs such that, as the joint opens, the slabs are allowed increasingly greater relative movement in a direction substantially parallel to the longitudinal axis of the joint; and wherein the tapered load plates define in use a cross section of tapered load plate material spanning the joint, and the cross section remains substantially constant between the saw cut being positioned on-center relative to the tapered load plates and the saw cut being, in at least one position of the saw cut, off-center relative to the tapered load plates;

at least one of the tapered load plates including a main plate portion and at least one extension, the main plate portion comprising a first end, a second end, and at least a first main plate portion side extending from between at least adjacent the first end and at least adjacent the second end, the first main plate portion side crossing the joint, and the at least one extension comprising at least a first extension side alongside the first main plate portion side.

16. The system of claim 15, wherein both the tapered load plates include main plate portions as in claim 15 and at least one extension also as described in claim 15.

17. The system of claim 15, wherein the tapered load plate that includes a main plate portion and at least one extension also includes a second extension, the main plate portion further comprising a second main plate portion side extending from between at least adjacent the first end and at least adjacent the second end, the second main plate portion side crossing the joint, and the second extension comprising at least a second extension side alongside the second main plate portion side.

18. The system of claim 15, further comprising a tapered-load-plate basket that positions the tapered load plates before the slabs are cast in place.

19. The system of claim 15 or claim 18, wherein the joint is a saw-cut control joint.

20. The system of claim 15, wherein the main plate portion of the tapered load plate having a main plate portion is steel and the extension includes a material that is more compressible than the main plate portion.

21. Apparatus for use in a system transferring loads between a first concrete on-ground cast-in-place slab and a second concrete on-ground cast-in-place slab, the system comprising the first and second slabs and a joint interposing the first and second slabs, at least the first slab having a substantially planar upper surface, at least a portion of the joint being initially defined by at least one of a crack, cut or a form oriented substantially perpendicular to the substantially planar upper surface of the first slab, wherein a longitudinal axis of the joint is formed by an intersection of the crack, cut or form and the upper surface of the first slab and wherein the joint is subject to opening through a variety of joint opening dimensions;

the apparatus comprising:

multiple first tapered load plates and multiple second tapered load plates, that each have a taper, protrude in use into the first and second slabs and have an extent in use across the joint such that the load plates span the joint and transfer between the first and second slabs a load applied to either of the slabs directed substantially perpendicular to the upper surface of the first slab; the tapered load plates each having a width in use measured parallel to the longitudinal axis of the joint; the width of each tapered load plate generally tapering from a relatively wide location in the extent of each plate across the joint to a relatively narrow portion; and a tapered-load-plate basket that facilitates positioning the tapered load plates in the area of the joint before the slabs are cast in place;

whereby in use, as the joint opens, a tapered gap opens between the load plates and the slabs near the narrow portions of the plates such that the slabs are allowed increasingly greater relative movement in the direction substantially parallel to the longitudinal axis of the joint; and whereby in use the multiple first and multiple second tapered load plates are oriented such that as the joint opens, reduced width of the first load plates at the narrowest width in the joint of the first load plates due to plate taper is compensated for by increased width of the second load plates in the joint due to opposing plate taper, such that as the joint opens, the combined widths of the multiple first and second tapered load plates in the joint is substantially consistent for load transfer across the joint; and whereby in use the tapered load plates restrict relative movement between the first and second slabs in a direction substantially perpendicular to the upper surface of the first slab, allow the joint to open by allowing the first and second slabs to move away from each other in a direction substantially perpendicular to the joint, allow for increasingly greater relative movement in a direction substantially parallel to the longitudinal axis of the joint as the joint opens, and maintain substantially consistent load transfer across the joint;

at least one of the tapered load plates including a main plate portion and at least one extension, the main plate portion comprising a first end, a second end, and at least a first main plate portion side extending from between at least adjacent the first end and at least adjacent the second end, the first main plate portion side crossing the joint, and the at least one extension comprising at least a first extension side alongside the first main plate portion side.

22. The system of claim 21, wherein both the tapered load plates include main plate portions as in claim 21 and at least one extension also as described in claim 21.

23. The system of claim 21, wherein the tapered load plate that includes a main plate portion and at least one extension also includes a second extension, the main plate portion further comprising a second main plate portion side extending from between at least adjacent the first end and at least adjacent the second end, the second main plate portion side crossing the joint, and the second extension comprising at least a second extension side alongside the second main plate portion side.

24. The system of claim 21 or claim 23, wherein the joint is a saw-cut control joint.

25. The system of claim 21, further comprising a tapered-load-plate basket that positions the tapered load plates before the slabs are cast in place.

26. The system of claim 21, wherein the main plate portion of the tapered load plate having a main plate portion is steel and the extension includes a material that is more compressible than the main plate portion.

* * * * *